United States Patent [19]

Regalbuto

[11] 4,290,486

[45] Sep. 22, 1981

[54] METHODS AND APPARATUS FOR SEVERING CONDUITS

[75] Inventor: John A. Regalbuto, Fort Worth, Tex.

[73] Assignee: Jet Research Center, Inc., Arlington, Tex.

[21] Appl. No.: 52,031

[22] Filed: Jun. 25, 1979

[51] Int. Cl.[3] ..... E21B 43/116

[52] U.S. Cl. ..... 166/297; 175/4.6; 102/312; 102/320

[58] Field of Search ..... 166/297, 55.1, 55; 102/20, 21.6, 67, 22, 24 HC; 175/4.6, 4.5, 4.51, 4.52

[56] References Cited

U.S. PATENT DOCUMENTS

| | | | |
|---|---|---|---|
| 2,837,027 | 6/1958 | Martin | 102/22 |
| 2,865,290 | 12/1958 | Bonsper | 102/22 |
| 3,048,103 | 8/1962 | Blair, Jr. et al. | 102/22 |
| 3,053,182 | 9/1962 | Christopher | 102/21.6 |
| 3,080,005 | 3/1963 | Porter | 175/4.6 |
| 3,233,688 | 2/1966 | Bell | 102/20 |
| 3,274,933 | 9/1966 | Robinson, Jr. et al. | 102/21.6 |
| 3,977,327 | 8/1976 | Brunfield | 102/67 |
| 4,184,430 | 1/1980 | Mock | 166/297 |

FOREIGN PATENT DOCUMENTS

| | | |
|---|---|---|
| 646560 | 8/1962 | Canada . |
| 2403589 | 9/1974 | Fed. Rep. of Germany . |
| 1018279 | 10/1952 | France . |
| 2061824 | 6/1971 | France . |
| 961324 | 8/1960 | United Kingdom . |

*Primary Examiner*—William F. Pate, III

*Attorney, Agent, or Firm*—Thomas R. Weaver; John H. Tregoning; C. Clark Dougherty, Jr.

[57] ABSTRACT

Apparatus for severing a conduit along a plane generally transverse to the axis of the conduit which includes two confined explosive charges aligned axially with the conduit and terminating at opposed proximal convexly shaped ends facing each other across a space disposed in such transverse plane. A liner formed of high density ductile material having radially increasing thickness is attached to each of the proximal ends of the charges and detonation devices are disposed at the distal ends of the charges for originating simultaneous detonation of the charges. Methods of severing conduits using the apparatus are also provided.

33 Claims, 21 Drawing Figures

METHODS AND APPARATUS FOR SEVERING CONDUITS

This invention relates to methods and explosive apparatus for selectively severing conduits, and in a specific aspect, to methods and apparatus for explosively effecting the in situ cutting of metal conduits used in drilling and completion of oil wells and the like at selected downhole locations.

In the drilling and completion of oil and gas wells, metal conduits such as drill strings, casing, tubing, etc., sometimes become fouled and obstructed so as to become stuck in the well bore below ground level. On occasion, attempts to free such conduits result in the loss of substantial parts thereof. It has been the practice to lower a suitable cutting tool into the conduit to the location where the fouling exists, and to there cut through or sever the conduit in order to free at least the upper portion of the conduit.

Cutting tools which include explosive charges have been utilized heretofore to sever relatively large diameter conduits at selected downhole locations. However, in severing small diameter conduits such as drill pipe and tubing, it has been found difficult to lower a sufficient amount of explosive to the locus of the fouling to sever the free upper section of the string from the obstructed lower section. This is especially true when it is sought to sever a drill or tubing string by cutting through a collar, since these coupling elements in the string have a substantially greater wall thickness than the thickness of the drill pipe or tubing sections. In some instances, the large amount of explosive required and the relatively small diameter of the conduit prevent an elongated cartridge or housing carrying the explosive charge from traversing bends or angulations in the conduit string. Even where larger amounts of explosive are susceptible to utilization, shock waves are frequently generated upon detonation which are of sufficient magnitude and are sufficiently widely dispersed that undesirable damage is caused to surrounding structure.

On other occasions during oil and gas well drilling, blowouts occur whereby drilling fluid circulation is lost and drilling cannot be resumed unless cementing can be effected at the location of the blowout. At times, it is possible to perforate a drill collar at the location of the blowout and to squeeze a sufficient amount of cement through the perforation by way of the drill string to alleviate the blowout. In such instances, it is necessary to sever or cut through the drill collar to a sufficient degree to permit an adequate quantity of cement to be forced through the collar at a high enough rate to permit the well to be plugged, a result often not possible prior to the present invention.

By the present invention, improved methods and apparatus are provided for efficiently and selectively severing relatively small diameter and/or thick-walled conduits at selected locations using explosive charges.

The severing apparatus of the present invention is comprised of a housing containing a pair of explosive charges which oppose each other and are aligned along the axis of the housing. The housing is transversely dimensioned to facilitate its insertion into a conduit to be severed at a selected location and the opposing or proximal ends of the explosive charges are convexly shaped such that they define between them an annular explosive-free space. The convexly shaped proximal ends of the two charges each include a liner formed of high density ductile material such as steel attached or positioned adjacent thereto having a configuration complementary therewith. The thickness of each of the liners is greater at the peripheral portion thereof than at the central portion thereof, i.e., the liners are of radially increasing thickness. Means are provided for detonating the charges at the distal ends thereof so that detonation waves are propagated axially within the housing and collide at the location of the proximal ends and liners of the two charges forming a high pressure region and propelling particles of the high density liner material in a plane substantially perpendicular to the axis of the housing.

In utilizing the apparatus of the invention for severing a downhole conduit string, the housing containing the explosive charges arranged in the manner described is placed upon the end of a suitable wire line carrying electrical conductors appropriate to effect detonation of the charges when a power source at the surface is activated. The apparatus is then lowered on the wire line to the desired depth within the conduit string which is to be severed. Detonation of the two explosive charges at the distally disposed ends thereof is then simultaneously initiated.

A particular advantage of the severing apparatus of the present invention is that a relatively small amount of explosive charge can be used to selectively sever or cut through relatively thick conduit and as a result the apparatus is relatively small and compact and can be easily lowered into a conduit string without being blocked or obstructed by bends or departures from linearity occurring over the length of the string. The apparatus concentrates and selectively directs the force generated by the explosion of a relatively small amount of high explosive and particles of high density liner material in such a way that a thick conduit or collar can be cleanly severed at a selected location without severely damaging surrounding structure.

In the drawings forming a part of this disclosure:

Figure 1:
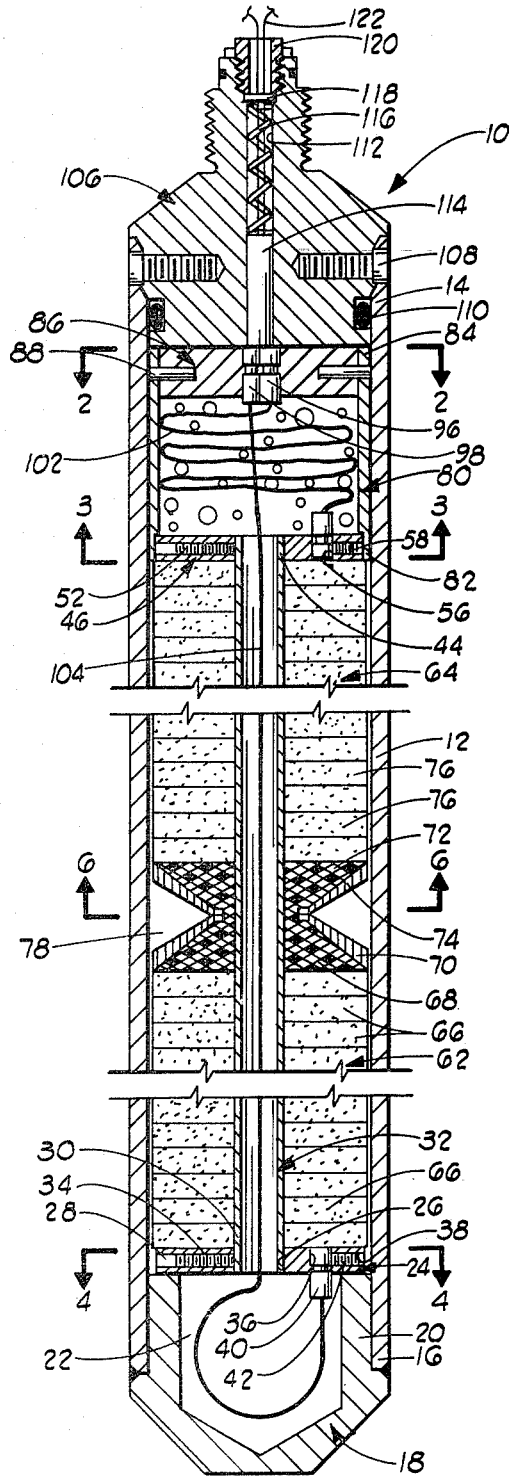
FIG. 1 is a vertical sectional view of one form of apparatus of the present invention.
Figure 2:
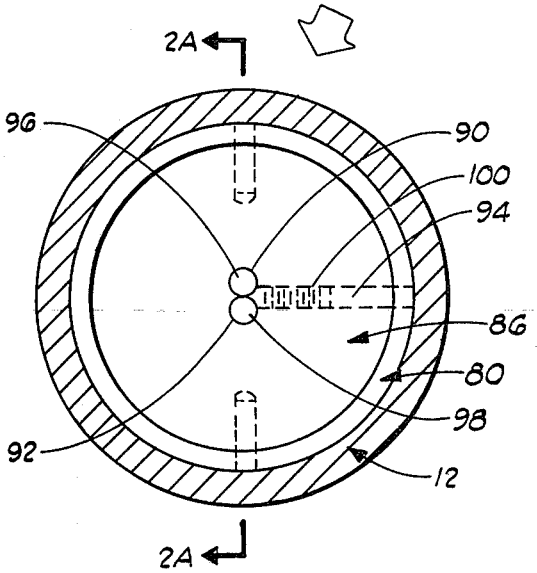
FIG. 2 is a sectional view taken along line 2—2 of FIG. 1.
Figure 2A:
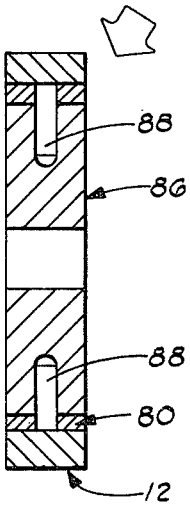
Figure 3A:
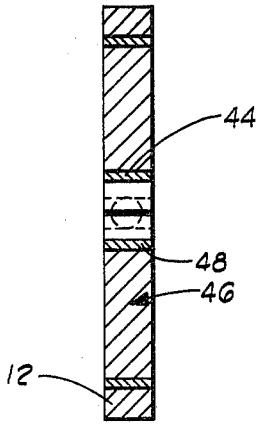
Figure 3:
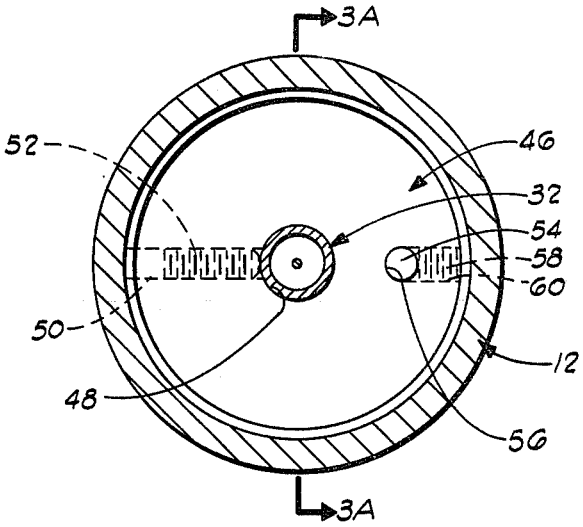
Figure 4A:
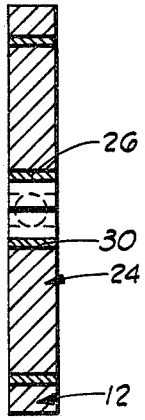
Figure 4:
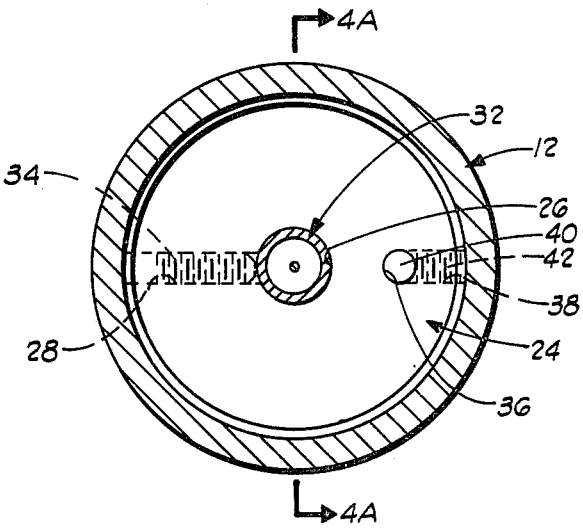
Figure 5A:
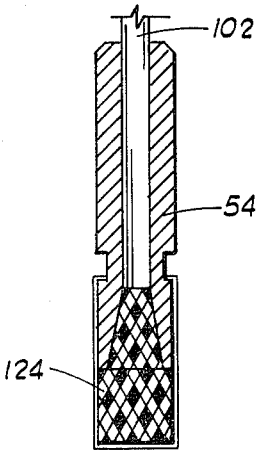
Figure 5B:
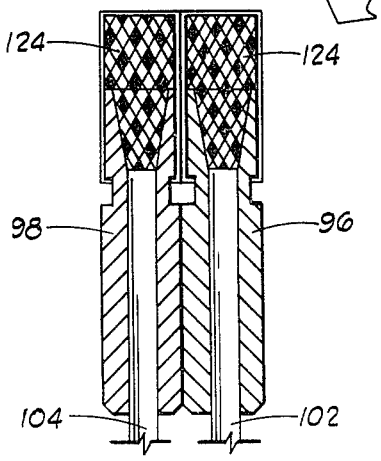
Figure 5:
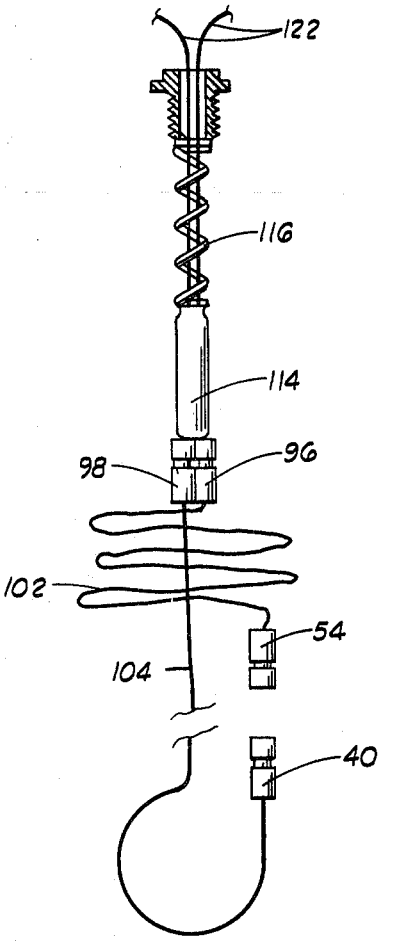
Figure 5C:
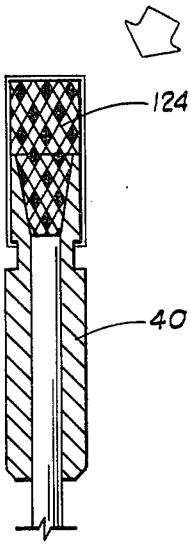
Figure 5A:
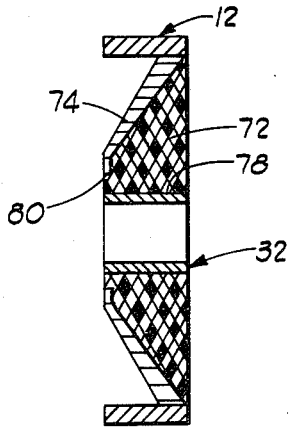
Figure 6:
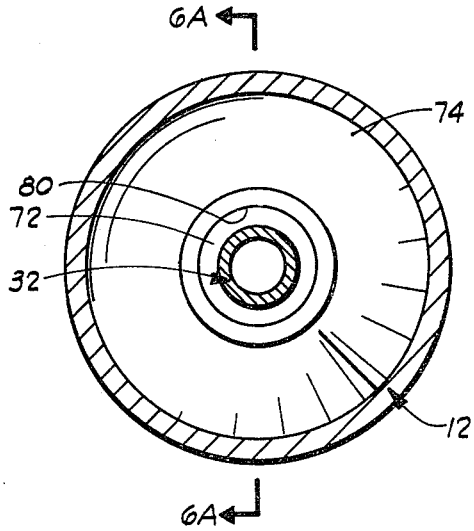
Figure 7:
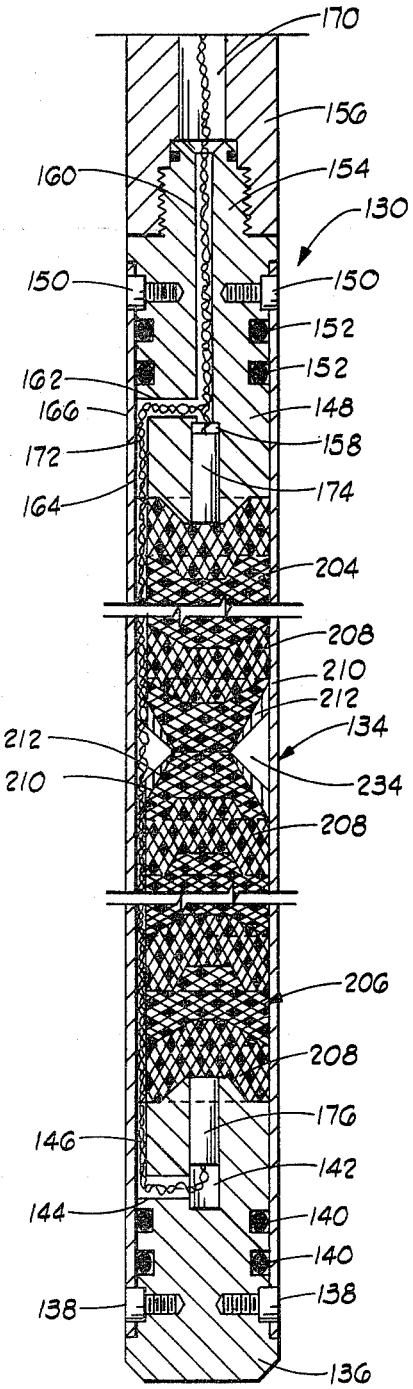
Figure 7A:
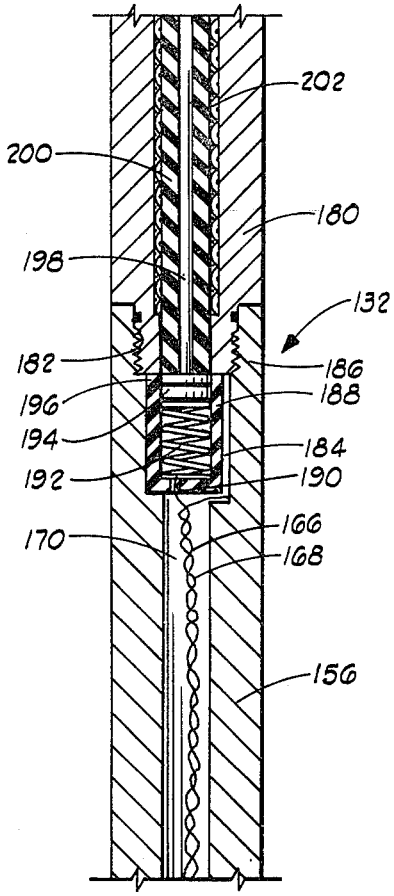
Figure 7B:
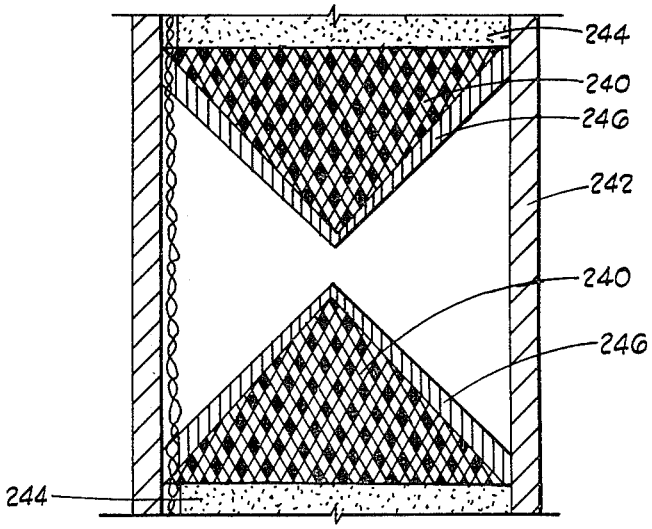
Figure 8:
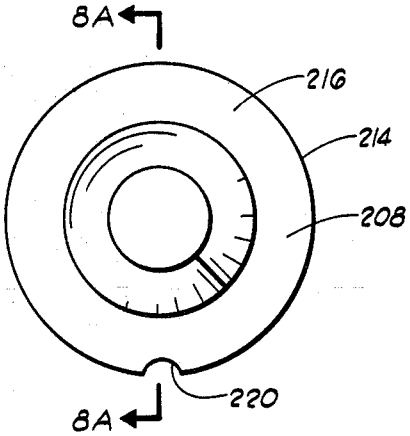
Figure 8A:
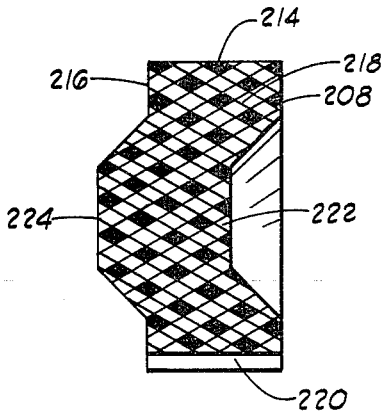
Figure 9:
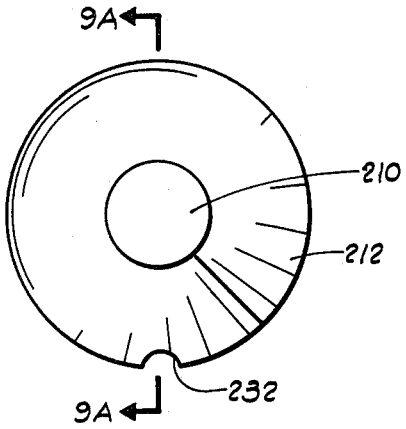
Figure 9A:
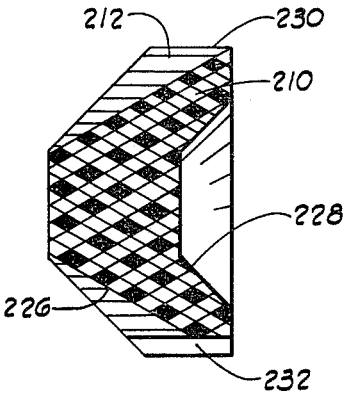

FIG. 2*a* is a sectional view taken along line 2*a*—2*a* of FIG. 2;

FIG. 3 is a sectional view taken along line 3—3 of FIG. 1;

FIG. 3*a* is a sectional view taken along line 3*a*—3*a* of FIG. 3;

FIG. 4 is a sectional view taken along line 4—4 of FIG. 1;

FIG. 4*a* is a sectional view taken along line 4*a*—4*a* of FIG. 4;

FIG. 5 is a diagrammatic view of the detonator elements and fuse means shown in FIG. 1;

FIGS. 5*a*, 5*b* and 5*c* are sectional views of the detonator elements shown in FIG. 5;

FIG. 6 taken along line 6—6 of FIG. 1 is a plan view of a truncated cone explosive cartridge and liner positioned adjacent thereto of the type used in the apparatus of FIG. 1;

FIG. 6*a* is a sectional view taken along line 6*a*—6*a* of FIG. 6;

FIG. 7 is a vertical sectional view of the lower portion of an alternate form of apparatus of the present invention;

FIG. 7*a* is a vertical sectional view of the upper portion of the apparatus of FIG. 7 and constituting a vertical continuation of the structure shown in FIG. 7;

FIG. 7*b* is a partial enlarged vertical sectional view showing an alternate form of opposing conical explosive cartridges and liners which can be used in the apparatus of FIG. 7;

FIG. 8 is a plan view of one of the explosive charge cartridges shown in FIG. 7;

FIG. 8*a* is a sectional view taken along line 8*a*—8*a* of FIG. 8;

FIG. 9 is a plan view of one of the opposing truncated cone explosive cartridges and liners shown in FIG. 7;

FIG. 9*a* is a sectional view taken along line 9*a*—9*a* of FIG. 9; and

Figure 10:
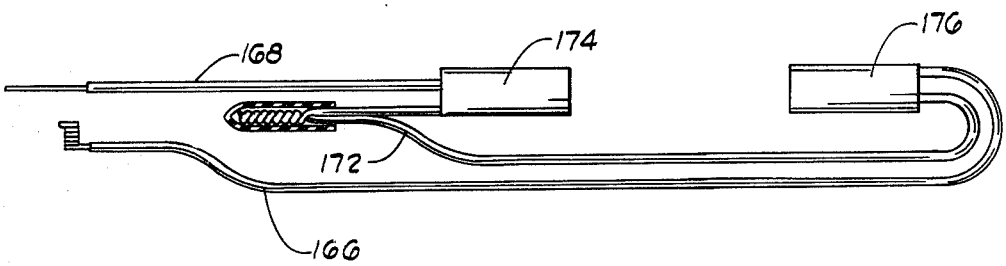

FIG. 10 is an electrical wiring diagram illustrating the manner in which the detonator elements shown in FIG. 7 are interconnected.

Referring now to the drawings, and particuarly to FIG. 1, one form of the conduit severing apparatus of the present invention is illustrated and generally designated by the numeral 10. The apparatus 10 includes an elongated cylindrical housing 12 having an upper end 14 and a lower end 16. The lower end 16 of the housing 12 is closed by a cap or plug 18 which is welded thereto. The plug 18 includes a cylindrical portion 20 which extends upwardly a short distance within the lower end 16 of the housing 12 whereby an upwardly facing annular shoulder is provided by the top of the cylindrical portion 20 and an open area or recess 22 is provided within the plug 18.

Positioned adjacent the plug 18 within the housing 12 and seated on the upwardly facing annular shoulder provided by the cylindrical portion 20 of the plug 18 is a charge support plate 24. As shown in FIGS. 1, 4 and 4*a*, the charge support plate 24 includes a central vertical opening 26 disposed therein which is intersected by a horizontal threaded bore 28 extending from a side of the support plate 24. Disposed within the central vertical opening 26 is the lower end 30 of a vertically extending fuse tube 32. The end 30 of the fuse tube 32 is fixedly held within the central opening 26 of the plate 24 by a set screw 34 disposed within the threaded bore 28. An eccentrically positioned vertical opening 36 is disposed within the plate 24 which is intersected by a threaded bore 38 extending horizontally in the plate 24 from a side thereof. Disposed within the bore 36 is a detonator element 40. The element 40 is fixedly held within the bore 36 by a set screw 42 threadedly disposed in the threaded bore 38.

The fuse tube 32 extends upwardly within the housing 12 and the upper end 44 therefore is fixedly attached to a second charge support plate 46. As shown in FIGS. 1, 3 and 3*a*, the charge support plate 46 is identical to the support plate 24 and includes a central vertical opening 48 intersected by a horizontal threaded bore 50. The upper end 44 of the fuse tube is fixedly held within the bore 48 by a set screw 52 threadedly disposed within the threaded bore 50. A detonator element 54 is disposed within an eccentrically positioned vertical opening 56 disposed in the plate 46 and is fixedly held therein by a set screw 58 threadedly disposed within a threaded bore 60 which intersects the opening 56. The detonator elements 54 and 40 are disposed such that their respective longitudinal axes coincide.

Positioned between the charge support plates 24 and 46 are a pair of opposing high explosive charges generally designated by the numerals 62 and 64. The lower upwardly facing high explosive charge 62 consists of a plurality of cylindrically shaped explosive cartridges 66 having central openings therein stacked one upon the other from the distal end thereof adjacent the charge support plate 24. The proximal end of the charge 62 consists of an explosive cartridge 68 formed in the shape of a truncated cone having a central opening therein positioned on top of and adjacent the uppermost cylindrical explosive cartridge 66. A metal liner 70 which will be described in greater detail herein is positioned on top of and over the upwardly facing conical surface of the explosive cartridge 68.

The upper high explosive charge 64 consists of an explosive cartridge 72 of inverted truncated conical shape having a central opening therein positioned adjacent and facing the explosive cartridge 68 of the high explosive charge 62. A metal liner 74 is positioned over the downwardly facing conical surface of the cartridge 72. A plurality of stacked cylindrical explosive charges 76 having central openings therein are positioned on top of the explosive cartridge 72 extending to the distal end of the high explosive charge 64 adjacent the charge support plate 46. The fuse tube 32 extends through the central openings in the explosive cartridges making up the charges 62 and 64 and along with the housing 12 maintains them in the stacked arrangement described.

The cylindrical explosive cartridges 66 and 76 of the charges 62 and 64 are identical in size, shape and number. The truncated cone shaped explosive charges 68 and 72 and the liners 70 and 74 at the proximal ends of the high explosive charges 62 and 64 are also identical in size and shape and define between them an annular explosive-free space 78. As shown in FIGS. 6 and 6*a* illustrating the explosive cartridge 72 and liner 74, a central axial opening 78 is provided in the cartridge 72 through which the fuse tube 32 passes. The liner 74 includes a central opening 80 of larger diameter than the central opening 78 in the cartridge 72 and extends to the periphery of the cartridge 72. Further, an annular portion of the explosive material making up the cartridge 72 extends between the outer surface of the fuse tube 32 and the sides of the opening 80 in the liner 74. As will be apparent, because the explosive cartridge 72 and liner 74 are identical in size and shape with the cartridge 68 and liner 70 when they are positioned adjacent each other as shown in FIG. 1, the annular portions of the cartridges 68 and 72 between the fuse tube 32 and internal ends of the liners 70 and 74, are in contact with each other.

As shown in FIGS. 1 and 6*a*, the thickness of each of the metal liners 70 and 74 increases from the internal sides thereof to the peripheral sides thereof. That is, as the radial distance from the axial center line of the liners increases, the thickness of the liners increases. This variation in thickness of the liners produces optimum conditions for the collision of forces produced upon detonation of the charges 62 and 64 at the proximal ends thereof. Such collision disintegrates the liners into high density particles which are dispersed and propelled radially in a plane perpendicular to the axis of the apparatus 10 and greatly enhance the conduit severing ability of the apparatus 10 as will be described in further detail hereinbelow.

Disposed within the upper end portion of the housing 12 above the charge support plate 46 is a sleeve 80 having a lower end 82 positioned adjacent the sides of the charge support plate 46 and an upper end 84. The upper end 84 of the sleeve 80 is closed by a circular plate 86 which is rigidly attached thereto by a pair of pins 88 extending through the sides of the sleeve 80 into corresponding bores in the sides of the plate 86. As seen in FIG. *2A*, a pair of adjacent, centrally positioned vertical openings 90 and 92 are disposed in the plate 86. As is shown in FIG. 2, the openings 90 and 92 are intersected by a threaded bore 94 extending horizontally in the plate 86 from a side thereof. A pair of detonator elements 96 and 98 are positioned within the openings 90 and 92, respectively, and are secured therein by a set screw 100 threadedly disposed in the bore 94. The element 96 is connected by a fuse 102 to the detonator element 54 attached to the plate 46. The detonator element 98 is attached by a fuse 104 to the detonator element 40 attached to the plate 24. The space between the plates 46 and 86 within the sleeve 80 is filled with a rubber-like potting compound such as a silicone rubber, whereby the fuse 102 is prevented from contacting the fuse 104 and the coiled portions of the fuse 102 are prevented from contacting each other.

The upper end 14 of the housing 12 is closed by a mandrel end plug 106. The mandrel end plug 106 is retained in the end 14 of the housing 12 by cap screws 108, and is sealed against the inside surfaces of the housing 12 by an O-ring 110. The mandrel end plug 106 includes a central bore 112 extending vertically therethrough and an electrically activated detonator element 114 is disposed within the bore 112 positioned adjacent and in contact with the detonator elements 96 and 98 secured in the plate 86. A spring 116 is positioned above the detonator element 114 for maintaining the element 114 in contact with the elements 96 and 98 and the spring 116 is maintained within the bore 112 by a spring button 118 and a sleeve 120 threadedly connected within a threaded recess in the mandrel end plug 106. As will be understood, the electric conductors 122 attached to the electrically fired detonator element 114 extends through the bore 112 in the mandrel end plug 106, the spring 116, spring button 118 and the sleeve 120. The electrical conductors 122 and the mandrel end plug are attached to a conventional wire line for lowering into a conduit to be served and surface activation of the electrically fired detonator element 114.

Referring now to FIGS. 5, 5*a*, 5*b* and 5*c*, the means for detonating the high explosive charges 62 and 64 are illustrated in detail. As will be understood by those skilled in the art, the electrical conductors 122 connected to the electrically fired detonator element 114 are in turn connected by way of a wire line to a source of electric current. Each of the detonator elements 98, 96, 54 and 40 includes a quantity of explosive material 124 at one end which is operably connected to an end of one of the fuses 102 or 104. Specifically, the explosive material 124 of the detonator 98 is connected to one end of the fuse 104 with the other end of the fuse 104 being connected to the explosive material 124 of the detonator 40. The explosive material 124 of the detonator 96 is connected to one end of the fuse 102 with the other end of the fuse being connected to the explosive material 124 of the detonator 54. In operation of the detonating means, the electrically fired detonator element 114 is fired by passing an electric current through the conductors 122. The firing of the element 114 detonates the explosive material 124 of the elements 96 and 98 which in turn ignites the fuses 102 and 104. The fuses 102 and 104 are of equal length and are formed of identical material such that the explosive material 124 in the detonator elements 40 and 54 are simultaneously ignited whereupon the high explosive charges 62 and 64 contained in the apparatus 10 are simultaneously exploded.

Referring now to FIGS. 7 and 7*a*, an alternate form of severing apparatus of the present invention is illustrated. The severing apparatus per se is generally designated by the numeral 130 and is illustrated in FIG. 7, and the upper portion of an adaptor 132 and a wire line cable head to which the adaptor is connected are shown in FIG. 7*a*.

The conduit severing apparatus 130 includes an elongated cylindrical housing 134, the lower end of which is closed by a plug 136. The plug 136 includes a portion extending into the lower end of the housing 134 and is secured thereto by cap screws 138. A pair of O-rings 140 are disposed in annular grooves formed in the plug 136 for providing a seal between the plug 136 and the inside surfaces of the housing 134. The plug 136 includes an axial cavity 142 which projects downwardly into the plug from the upper end thereof and communicates with a transverse passageway 144 which projects radially into the plug from the outer periphery thereof. A peripheral, axially extending groove 146 is formed along the outer side of the plug 136 parallel to the cavity 142, and projects from the upper side of the plug to a point of communication with the transverse passageway 144. The upper side of the plug 136 at which the central cavity 142 opens preferably includes a frusto-conical protuberance of a configuration to mate with a frusto-conically shaped cavity formed in a high explosive cartridge hereinafter described.

At the upper end of the housing 134, the housing is closed by a mandrel end plug 148. The mandrel end plug 148 is retained in the housing 134 by cap screws 150 and is sealed against the inside surfaces of the housing 134 by O-rings 152. The mandrel end plug 148 includes an externally threaded neck portion 154 at the upper end thereof which projects into and threadedly engages an internally threaded socket in the lower end of an adaptor 156.

The lower end of the mandrel end plug 148 which extends downwardly within the housing 134 is substantially identical in configuration to the frusto-conical protuberance at the upper end of the plug 136. An axial or central cavity 158 extends into the mandrel end plug from the apex or lowermost portion of the protuberance, and communicates with an elongated axial bore 160 which extends through the end plug from the upper end thereof. A transverse passageway 162 projects radially inwardly from one side of the plug 148 to intersect and communicate with the axial bore 160 at a location immediately above the axial cavity 158. The transverse passageway 162 registers with a groove 164 formed in an axial direction along the outer periphery of the end plug 148 and terminating in the lower end face of the plug.

As shown in FIGS. 7 and 7*a*, a pair of electrical conductors 166 and 168 extend downwardly through an axial bore 170 in the adaptor 156 and through the axial bore 160 in the end plug 148 to the intersection of the transverse passageway 162 with the axial bore 160. At this location, the conductor 166 and another electrical conductor 172 extend out through the transverse passageway and project downwardly through the groove 164 along the side of the housing 134 to the lower end thereof. There the conductors 166 and 172 enter the groove 146 in the plug 136 and pass through the transverse passageway 144 into the axial cavity 142 in the plug. The conductor 168 is connected at its lower end to a detonator element 174 which is positioned in the cavity 158 with its lower end flush with the lower end of the frusto-conical protuberance of the mandrel end plug 148. The conductor 172 is also connected to the detonator element 174 and the lower ends of the conductors 166 and 172 are connected to a detonator element 176 which is positioned in the cavity 142 and has its upper end flush with the upper end of the frusto-conical protuberance at the upper end of the plug 136. As most clearly shown in FIG. 10, the detonator elements 176 and 174 are connected by the conductors 166, 168 and 172 in series.

The conductors 166 and 168 are made a part of an electrical circuit extending to the surface or to the top of a conduit to be severed where a power source and switch are located for energizing and closing the circuit. This is accomplished by connection of the conductors 166 and 168 to the lower end of a cable head 180 suspended upon the lower end of a conventional wire line. The adaptor 156 has an internally threaded recess 182 formed in the upper end thereof and communicating with the open upper end of an axial cavity 184 in the adaptor. The cavity 184 in turn communicates with the axial bore 170 which extends downwardly in the adaptor to the mandrel end plug 148. The recess 182 threadedly receives an externally threaded pin 186 formed on the lower end of the cable head 180. The lower end of the pin 186 abuts the upper end of a spring box 188 constructed of an electrically non-conductive material seated in the cavity 184. The conductor 168 is extended around the outer side of the box 188 and is suitably grounded to the metallic wall of the adaptor 156. A small opening 190 is formed in the bottom of the box 184 and functions to permit extension into the interior of the box by the conductor 166. Inside the box 188, the conductor 166 is connected to a helical spring 192 disposed therein. The spring 192 functions to resiliently urge or bias a contactor plate 194 upwardly into contact with a contact head 196 secured to the lower end of a flexible electric conductor element 198 forming a part of the cable head 180. The conductor element 198 is enclosed within a tube 200 formed of non-conductive material and the tube 200 is in turn enclosed in a braided shield 202 of conventional construction. The entire cable head is of conventional construction and is attached to the lower end of a wire line (not shown).

A pair of explosive charges, generally designated by the numerals 204 and 206, are disposed within the housing 134 between the plug 136 and the mandrel end plug 148. The charges 204 and 206 are of identical shape and size and are positioned facing each other. The lower high explosive charge 206 consists of a plurality of truncated explosive cartridges 208 stacked one upon the other with a truncated conical explosive cartridge 210 positioned on top of the stack. A metal liner 212 of truncated conical configuration corresponding with the configuration of the explosive cartridge 210 is positioned over the conical surfaces of the cartridge 210. The upper high explosive charge 204 is identical to the lower charge 206 in that it consists of a plurality of stacked truncated explosive cartridges 208 and a truncated conical cartridge 210 and liner 212.

One of the truncated explosive charges 208 is illustrated in FIGS. 8 and 8*a* and one of the truncated conical charges 210 with liner 212 attached thereto is illustrated in FIGS. 9 and 9*a*. Referring to FIGS. 8 and 8*a*, the explosive cartridge 208 is a body of a suitable high explosive material which is formed having a generally cylindrical outer periphery 214 intersected by a pair of substantially parallel, axially spaced planar faces 216 and 218. Extending between the end faces 216 and 218 at one side of the cartridge 208 is a peripheral groove 220 which extends parallel to the axis of the housing 134 of the apparatus 130 and functions to pass the electrical conductors 166 and 172 down one side of the housing for connection to the lower detonator element 176. A frusto-conical cavity 222 is formed in the planar end face 218 of each truncated cartridge 208, and a truncated protuberance or projection 224 complementary in configuration to the cavity 222 is formed upon and projects out of the planar end face 216. This configuration of the explosive cartridges 208 permits them to be stacked in nesting relationship within the housing 134 as shown in FIG. 7 with the lowermost cartridge 208 in the lower high explosive charge 206 nestably receiving the complementary frusto-conical projection at the upper end of the plug 136. The uppermost cartridge 208 in the upper high explosive charge 204 nestably receives the downwardly projecting complementary frusto-conical protuberance formed on the lower end of the mandrel end plug 148. At the proximal ends of each of the upper and lower high explosive charges 204 and 206 adjacent the lowermost and uppermost cartridge 208, respectively, is the frusto-conical cartridge 210 and liner 212 illustrated in detail in FIGS. 9 and 9*a*. The cartridges 210 include a truncated conically shaped outer surface 226 and a truncated conical recess 228 for receiving the truncated conical protuberance of an explosive charge 208. The liner 212 attached to the outer surface 226 of the explosive cartridge 210 has a cylindrical outer peripheral surface 230 which is grooved along one side by a peripheral groove 232 extending parallel to the axis of the housing 134 of the apparatus 130. The grooves 232 of the liners 212 and cartridges 210 are aligned with the grooves 220 of the cartridges 208 to allow the passage of the electrical conductors 166 and 172 therethrough. The liners 212 of the explosive cartridges 210 are of truncated conical shape and are of increasing thickness from the interior portions to the peripheral portions thereof.

As shown in FIG. 7, the truncated conical cartridges 210 and liners 212 which are the proximal ends of the charges 204 and 206 face each other with the truncated outer portions thereof in contact with each other. In addition, the truncated apex portions of the liners 212 contact each other, and an annular explosive-free area 234 (FIG. 7) is formed in the housing 134 of the apparatus 130 between the liners 212.

Referring now to FIG. 7*b*, an alternate form of explosive cartridge and liner which can be substituted for the explosive cartridge 210 and liner 212 in the apparatus 130 or the explosive cartridges 68 and 72 and liners 70 and 74 of the apparatus 10 is illustrated. In FIG. 7*b*, the opposing proximal end explosive cartridges are designated by the numeral 240 and are shown disposed in a housing 242. The cartridges 240 are conical in shape and are positioned adjacent additional explosive cartridges 244 making up upper and lower high intensity explosive charges of the type described above in connection with the apparatus 10 and 130. Conically shaped liners 246 are attached to each of the explosive cartridges 240, which like the liners 70 and 74 and 212 of the apparatus 10 and 130 described above, have thicknesses which increase as the distance from the axial center line of the housing 242 increases. While the apexes of the liners 246 can touch each other as do the cartridges and liners of the apparatus 10 and 130, the liners 246 of FIG. 7*b* are illustrated positioned a distance apart designated by the letter "d". In the most preferred embodiment of conduit severing apparatus of this invention, the explosive cartridges and/or liners at the proximal ends of the two high explosive charges used in the apparatus touch each other. However, in all of the embodiments of the apparatus illustrated and described herein, the proximal end explosive cartridges and liners can be separated from each other by a specific distance. However, the maximum distance between the proximal end explosive cartridges and/or liners which results in the effective operation of the conduit severing apparatus has been found to be 4 times the thickness of one of the liners at its thickest point. Thus, in FIG. 7, the maximum thickness of one of the liners 246 is the thickness at the peripheral edge of the liners designated in FIG. 7*b* by the letter "t". Accordingly, the maximum distance d between the liners 246 shown in FIG. 7*b* is 4 times t. A more preferred distance between the proximal explosive cartridges and/or liners of the conduit severing apparatus of this invention is 2 times the thickness of one of the liners at its thickest point or, as illustrated in FIG. 7*b*, 2 times t. The distance between the proximal end explosive cartridges and/or liners which has been found to bring about the best results in severing conduit is where the distance d is in the range of from 0 to not more than ½ the thickness of one of the liners at its thickest point, i.e., still referring to FIG. 7*b*, where the apexes of the liners 246 touch each other or are not more further apart than where the distance d is equal to ½t.

The types of high explosive materials used in the explosive cartridges making up the high explosive charges 62 and 64 of the apparatus 10, the high explosive charges 204 and 206 of the apparatus 130 and the explosive charges of the detonator elements 40, 54, 96, 98 and 114 of the apparatus 10 and detonator elements 174 and 176 of the apparatus 130, can vary widely. Examples of suitable high explosives are those described in U.S. Pat. No. 3,865,436 to Dorrough and Brown issued Feb. 11, 1975. The explosives RDX (Cyclotrimethylenetrinitramine, Hexahydro-1, 3, 5-Trinitro-5-Triazine, Cyclonite, Hexogen, T4), HMX (octogen) and COMP B (Cyclotol) are preferred.

In operation of the apparatus 10 and the apparatus 130 for severing a downhole conduit or collar in a well bore, the apparatus is placed in a selected downhole location by lowering it through the conduit to be severed or string of such conduit on a wire line.

As described above, the apparatus is connected in the usual manner to a conventional cable end at its upper end and the electrical conductors of the apparatus are interconnected by way of the wire line to a power source and switch closure at the surface. The apparatus is positioned such that the proximal ends of the high explosive charges and the annular explosive-free space formed thereby lie in a transverse plane extending through the conduit to be severed at the desired location of severance. That is, with respect to the apparatus 10, the point of contact of the explosive cartridges 68 and 72 and liners 70 and 74 at the proximal ends of the high explosive charges 62 and 64 is located with respect to the conduit to be severed in a transverse plane passing through the plane of severance. With respect to the apparatus 130, the point of contact of the explosive cartridges 210 and liners 212 is located in the plane of severance. When proximal end explosive cartridges and liners are utilized in the conduit severing apparatus like those illustrated in FIG. 7*b* or the equivalent, the point half-way between the apexes of the liners 246 is positioned in a plane which projects normal to the axis of the conduit to be severed as well as to the aligned axis of the conduit severing apparatus.

Once the conduit severing apparatus of this invention is positioned within the conduit to be severed at the desired location, the detonator elements utilized in the apparatus are electrically actuated by closure of a suitable switch located at the surface to thereby close the electrical circuit to the detonators. In the case of the apparatus 10, upon closure of the electrical circuit, the detonator element 114 (see FIGS. 1, 5, 5*a*, 5*b* and 5*c*) is caused to explode which in turn causes the detonator elements 96 and 98 to explode simultaneously. The simultaneous explosion of the elements 96 and 98 ignites the fuses 102 and 104 which, because such fuses are of identical length, size, etc., cause the simultaneous explosion of the detonator elements 40 and 54. Explosion of the detonator elements 40 and 54 simultaneously initiates or originates the explosion of the high explosive charges 62 and 64 at their distal ends.

In the apparatus 130, the closure of the electrical circuit connecting the electrically fired detonator elements 174 and 176 (see FIGS. 7 and 10) causes the simultaneous explosion of the detonator elements 174 and 176 which in turn initiates the explosion of the high explosive charges 204 and 206 simultaneously at their distal ends.

As the high explosive charges of the apparatus 10 or 130 explode, the detonation waves generated thereby collide at the adjacent proximal ends of the charges causing the opposing liners formed of high density ductile material to collide in the explosive free area therebetween. The collision of the liners and the collision of the detonation waves forms an extremely high pressure zone which is dispersed radially along with the high density ductile material particles produced in a plane perpendicular to the direction of propagation of the original detonation waves, i.e., perpendicular to the axis of the severing apparatus. The high density material and high pressure planar wave produced by the explosion cut through the housing of the severing apparatus and impact the conduit to be severed generating very high localized pressures thereon. These pressures cause the conduit to fracture in a generally horizontal plane perpendicular to the longitudinal axis of the conduit.

As will be understood by those skilled in the art, in order to achieve a maximum effect of the high pressure forces created by the simultaneous explosion of the opposing high explosive charges of the apparatus of the present invention, the outside diameter of the housing of the apparatus cannot be so small as compared to the internal diameter of the conduit to be severed that the localized high pressure forces produced and high density liner particles must travel an inproportionate distance before contacting the internal surface of the conduit to be severed. The size of the conduit severing apparatus utilized also depends on the wall thickness of the conduit to be severed. For example, if the wall thickness of the conduit to be severed is small, a relatively small diameter cutter apparatus can be utilized. On the other hand, if the wall thickness of the conduit to be severed is large, the severing apparatus must be of a larger size. More specifically, the conduit severing apparatus of this invention is particularly useful and advantageous in its ability to cut through conduit having a wall thickness exceeding two inches and to sever conduits characterized by an outside diameter to an inside diameter ratio (hereinafter referred to as conduit ratio) as great as 3.5:1.

As concerns the size of the conduit severing apparatus, in order to achieve optimum severing results, the ratio of the outside diameter of the severing apparatus housing to the inside diameter of the conduit to be severed (hereinafter referred to as cutter ratio) should be in the range of from about 0.3 to about 0.95. Cutter ratios from 0.95 to slightly less than 1 can be utilized so long as the conduit severing apparatus can be inserted and moved within the conduit to be severed. Most preferably, where the conduit ratio is in the range of from about 1.3:1 or less, the cutter ratio is in the range of from about 0.3 to about 0.95. Where the conduit ratio is in the range of from about 1.3:1 to about 3.5:1, the cutter ratio is in the range of from about 0.8 to about 0.95.

In a typical construction of the conduit severing apparatus of the present invention and the application thereof, the housing in which the high explosive charges are located will have an outside diameter of from about $\frac{5}{8}$ inch up to about $2\frac{5}{8}$ inches. The housing wall thickness will be in the range of from about 1/16 inch to about $\frac{1}{4}$ inch and the length of each of the opposing high explosive charges formed of RDX will be in the range of from about 9 to about 12 inches. Such a conduit severing apparatus will effectively bring about the severance of conduits having internal diameters of from about $\frac{3}{4}$ to about 3 inches and conduit ratios of from about 1.3:1 to about 3.5:1.

As will be further apparent to those skilled in the art, the mass and configuration of the liners utilized at the proximal ends of the high explosive charges in the conduit severing apparatus of this invention materially affect the operational results achieved. As described above, the liners utilized are formed of high density ductile materials whereby upon the simultaneous explosion of the opposed high explosive charges, the liners collide in the annular explosive-free space provided therebetween and are disintegrated into high density particles. The high density particles are propelled at an extremely high velocity radially outwardly in a plane transverse to the axis of the severing apparatus and impact the inside wall surfaces of the conduit to be severed, greatly enhancing the severing ability of the apparatus. If the mass of the liners utilized is too small, the impact will have little affect and the severing ability of the apparatus will not be enhanced to a great degree over apparatus where no liners are utilized. If the mass of the liners used is too great, the particles produced will be large and will not strike the wall surfaces of the conduit being severed with a great enough force to enhance the severing ability of the apparatus. In this regard, in order to bring about an appreciable increase in severing ability of the apparatus, the ratio of the mass of each liner used to the mass of the high explosive charge utilized with the liner should be in the range of from about 0.1 to about 10. For optimum operational results, the ratio of the mass of each liner to mass of explosive charge used therewith is preferably in the range of from about 0.1 to about 0.2.

As described above, the liners utilized in accordance with this invention are formed of high density ductile material of conical or truncated conical configuration. In addition, the liners are of radially increasing thickness. That is, the thickness of the liners increase as the distance from the axis of the liners which corresponds to the axis of the apparatus housing increases with the greatest thickness being at the outside peripheral edge of the liners. This configuration and varying thickness brings about the most efficient particulation of the liners upon impact with each other and the greatest impact with the inside wall surfaces of the conduit to be severed. As illustrated in the drawings and particularly FIGS. 6 and 6*a* relating to the apparatus 10 and FIGS. 9 and 9*a* relating to the apparatus 130, the liners can be of truncated conical shape whereby the central portions thereof include a circular opening therein. On the other hand, and as shown in FIG. 7*b*, the liners utilized can be conical in configuration and include a solid central portion. In either case, the minimum thickness of the liners is at the vortex or truncated apex thereof and the maximum thickness is at the peripheries of the liners. While different variations in thickness can be utilized, it is preferred that the maximum thickness of the liners not exceed 0.125 times the peripheral diameter of the liners. The angle of the outside surface envelope of the liners with a line perpendicular to the axes of the liners (designated $\theta$ in FIGS. 6*a*, 9*a* and 7*b*) can also vary, but is preferably within the range of from about 5° to about 75°. The angle of the inside surface envelope of the liners with a line perpendicular to the axes of the liners (designated $\phi$ in the FIGURES mentioned above) is preferably within the range of from 5° to about 75°.

In a typical construction of the liner illustrated in FIG. 9*a*, $\theta$ is 44°, $\phi$ is 52°, the radius of the central circular opening at the truncated apex of the liner is 0.28 inch and the thickness of the liner at the interior edge of the circular opening is 0.06 inch. The liner has a peripheral diameter of 1.44 inches and is 0.18 inch thick at the peripheral edge thereof.

While preferred embodiments of the present invention have been described herein in order to provide illustrations of the basic principles which underlie this invention, it will be understood that various changes in the construction and arrangement of the parts of the structure can be made by those skilled in the art without departing from the spirit and scope of the invention as defined by the appended claims or reasonable equivalents thereof.

What is claimed is:

1. Apparatus for severing a conduit along a plane extending transversely through the conduit comprising:

two aligned, confined cylindrical explosive charges positioned relative to each other for alignment along the longitudinal axis of the conduit and each including a distal end and a convexly shaped proximal end, said proximal ends facing each other and defining an explosive-free space separating the remaining portion of one of the charges from the remaining portion of the other charges;

a liner formed of high density ductile material positioned adjacent each of said proximal ends of said charges, said liners having shapes conforming with the shapes of said proximal ends of said charges and having radially increasing thicknesses; and means at the distal ends of said charges for simultaneously initiating detonation of the charges at the distal ends thereof.

2. The apparatus of claim 1 which is further characterized to include a cylindrical housing enclosing said confined explosive charge.

3. The apparatus of claim 2 wherein the ratio of the mass of said liners to the mass of explosive charges is in the range of from about 0.1 to about 10.

4. The apparatus of claim 3 wherein said proximal ends of said charges and said liners are of conical shape.

5. The apparatus of claim 3 wherein said proximal ends of said charges and said liners are of truncated conical shape.

6. The apparatus of claim 3 wherein each of said charges is comprised of a plurality of stacked explosive cartridges.

7. The apparatus of claim 3 wherein said liners are in contact with each other.

8. The apparatus of claim 3 wherein the proximal ends of said charges and said liners do not touch each other and the distance therebetween is no greater than 4 times the thickness of one of said liners at its thickest point.

9. The apparatus of claim 3 wherein the proximal ends of said charges and said liners do not touch each other and the distance between said liners is no greater than 2 times the thickness of one of the liners at its thickest point.

10. The apparatus of claim 3 wherein each of said charges includes:

a plurality of cylindrical explosive cartridges serially stacked; and a conical explosive cartridge in contact with one of said cylindrical cartridges forming one of said proximal ends.

11. A downhole well conduit severing apparatus comprising:

an elongated cylindrical housing;

means connected to one end of said housing for lowering said housing to a downhole location in said conduit;

first explosive charge means in the housing and having a first end and a convexly shaped second end;

a liner formed of high density ductile material attached to the second end of said first explosive charge having a shape conforming with the shape of said second end and having a radially increasing thickness;

second explosive charge means in the housing in axial alignment with said first explosive charge means and having a first end and a convexly shaped second end in proximity to the second end of said first explosive charge;

a second liner formed of high density ductile material attached to the second end of said second explosive charge means having a shape conforming with the shape of said convex second end and having a radially increasing thickness; and a first detonator element at the first end of said first charge means and a second detonator element at the first end of said second charge means.

12. The apparatus of claim 11 wherein said lowering means comprises a wire line.

13. The apparatus of claim 12 which is further characterized to include electrical circuitry connected to said detonator elements for electrically firing said elements comprising electrical conductors extending through said lowering means for controlling the circuitry from a surface.

14. The apparatus of claim 13 wherein each of said first and second explosive charge means comprises:

a conically configured explosive cartridge having its apex comprising said second end of the respective charge; and a plurality of nestable explosive charges stacked axially in said housing in internested array and including one nestable cartridge in contact with the base of the conically configured cartridge.

15. The apparatus of claim 14 wherein each of said nestable cartridges comprises a body of explosive having:

a cylindrical outer peripheral surface mated to the inside diameter of said housing;

a pair of spaced, parallel planar end surfaces intersecting the peripheral surface;

a cavity extending into one of said end surfaces; and a protuberance complementary in configuration to said cavity and projecting from the other of said end surfaces for registering engagement with the cavity of an adjacent nestable cartridge.

16. The apparatus of claim 14 wherein each of said conically configured cartridges includes a conical surface comprising the convex second end of one of said cartridges and a surface defining a cavity on the opposite side of the respective conically configured cartridge from said conical surface.

17. The apparatus of claim 14 wherein each of said first and second explosive charge means comprises:

a conically configured explosive cartridge having an axial circular opening extending therethrough and having its apex comprising said second end of the respective charge; and a plurality of explosive cartridges having axial circular openings extending therethrough and stacked axially in said housing in an array, one of said cartridges being in contact with the base of the conically configured cartridge.

18. The apparatus of claim 14 wherein the ratio of the mass of said first and second liners to the mass of said first and second explosive charges is in the range of from about 0.1 to about 10.

19. The apparatus of claim 18 wherein the second ends of said first and second explosive charge means and said first and second liners are of conical shape.

20. The apparatus of claim 19 wherein said first and second liners are in contact with each other.

21. The apparatus of claim 19 wherein said first and second liners do not touch each other and the distance therebetween is no greater than 4 times the thickness of one of said liners at its thickest point.

22. The apparatus of claim 19 wherein said first and second liners do not touch each other and the distance between said liners is no greater than 2 times the thickness of one of the liners at its thickest point.

23. A method of severing a conduit along a plane extending normal to the axis thereof comprising:

configuring two explosive charges as elongate bodies terminating in convexly shaped end portions;

attaching a liner formed of high density ductile material to each of the convexly shaped end portions of said charges, said liners being convexly shaped to conform to the shapes of said end portions and having radially increasing thicknesses;

confining the two charges in a closed, elongated housing sized for insertion in the conduit with the elongate bodies in longitudinal alignment and with the convexly shaped end portions thereof and liners attached thereto in close proximity with each other;

positioning the housing inside the conduit with the convexly shaped end portions of said charges substantially in the desired plane of severance of said conduit; and simultaneously detonating said charges by initiating the explosive thereof at points therealong substantially equidistant from the convexly shaped end portions.

24. The method of claim 23 wherein the ratio of the outside diameter of said housing to the inside diameter of said conduit is in the range of from about 0.3 to slightly less than 1.

25. The method of claim 23 wherein the conduit to be severed has a ratio of outside diameter to inside diameter of 1.3:1 or less and the ratio of the outside diameter of said housing to the inside diameter of said conduit is in the range of from about 0.3 to about 0.95.

26. The method of claim 23 wherein the conduit to be severed has a ratio of outside diameter to inside diameter in the range of from about 1.3:1 to about 3.5:1 and the ratio of the outside diameter of said housing to the inside diameter of said conduit is in the range of from about 0.8 to about 0.95.

27. The method of claim 24 wherein the ratio of the mass of said liners to the mass of explosive charges is in the range of from about 0.1 to about 10.

28. The method of claim 24 wherein the convexly shaped end portions of said bodies and liners are of conical shape.

29. The method of claim 24 wherein the convexly shaped end portions of said bodies and liners are of truncated conical shape.

30. The method of claim 24 wherein each of said charges are comprised of a plurality of stacked explosive cartridges.

31. The method of claim 30 wherein said liners are in contact with each other.

32. The method of claim 30 wherein the convexly shaped end portions of said charges and said liners do not touch each other and the distance therebetween is no greater than 4 times the thickness of one of said liners at its thickest point.

33. The method of claim 30 wherein the proximal ends of said charges and said liners do not touch each other and the distance between said liners is no greater than 2 times the thickness of one of the liners at its thickest point.

* * * * *